US006068521A

United States Patent [19]

Oros et al.

[11] Patent Number: 6,068,521

[45] Date of Patent: May 30, 2000

[54] KEYING MECHANISM FOR A MODULAR I/O ASSEMBLY

[75] Inventors: Donald L. Oros, Solon; Richard Benson, Jr., Mentor, both of Ohio

[73] Assignee: Elsag International N.V., Amsterdam Zuidost, Netherlands

[21] Appl. No.: 08/936,651

[22] Filed: Sep. 24, 1997

Related U.S. Application Data

[60] Provisional application No. 60/027,881, Oct. 4, 1996.

[51] Int. Cl.[7] ..... H01R 13/645

[52] U.S. Cl. ..... 439/681

[58] Field of Search ..... 439/680, 681, 439/677

[56] References Cited

U.S. PATENT DOCUMENTS 4,398,779 8/1983 Ling ..... 439/680

5,354,211 10/1994 Svette, Jr. et al. ..... 439/381

FOREIGN PATENT DOCUMENTS 2708291 8/1978 Germany ..... 439/681

*Primary Examiner*—Neil Abrams
*Attorney, Agent, or Firm*—Vytas R. Matas

[57] ABSTRACT

The present invention is drawn to an I/O block (38) assembly comprises a plurality of specifically configured I/O blocks (38) mounted to a conductive column (46) providing power to and communication between the I/O blocks (38) with each individual I/O block (38) programed for a specific function requiring that the proper I/O module (42) must always be inserted into the right base (40). This is accomplished by providing a set of pegs or pins (50) individually configured on the base (40) which match a complimentary series of openings 74 on the I/O module (42) formed by a mask (70) covering a plurality of holes (60) while leaving the holes matching the pins (50) uncovered.

13 Claims, 6 Drawing Sheets

KEYING PATTERNS ARE SHOWN BELOW:
("X" REPRESENTS KEYING POSITION)

| 1990061 LABEL PART # AND SUFFIX → | R → | A1 | A2 | A3 | A4 | A5 | A6 | A7 | A8 | A9 | A10 | A11 | A12 | | | | | | | | | | | | | | | | | |
|---|---|---|---|---|---|---|---|---|---|---|---|---|---|---|---|---|---|---|---|---|---|---|---|---|---|---|---|---|---|---|
| BLOCK NOMEN-CLATURE → | HOLE IKD↓ | A1100 | A1200 | A1220 | A1300 | A0150 | D10100 | D10200 | D11300 | D11400 | D0100 | D0120 | C10100 | FUTURE | FUTURE | FUTURE | FUTURE | FUTURE | FUTURE | FUTURE | FUTURE | FUTURE | FUTURE | FUTURE | FUTURE | FUTURE | FUTURE | FUTURE | FUTURE | FUTURE |
| UPPER HOLES | U1 | X | X | X | X | X | X | X | | | | | | | | | | | | | | | | | | | | | | |
| | U2 | X | | | | | | | X | X | X | X | X | X | | | | | | | | | | | | | | | | |
| | U3 | | X | | | | | | X | | | | | | X | X | X | X | X | | | | | | | | | | | |
| | U4 | | | X | | | | | | X | | | | | X | | | | | X | X | X | X | | | | | | | |
| | U5 | | | | X | | | | | | X | | | | | X | | | | X | | | | X | X | X | | | | |
| | U6 | | | | | X | | | | | | X | | | | | X | | | | X | | | X | | | X | X | | |
| | U7 | | | | | | X | | | | | | X | | | | | X | | | | X | | | X | | X | | X |
| | U8 | | | | | | | X | | | | | | X | | | | | X | | | | X | | | X | | X | X |
| | | | | | | | | | | | | | | | | | | | | | | | | | | | | | | |
| LOWER HOLES | L1 | X | X | X | X | X | X | X | | | | | | | | | | | | | | | | | | | | | | |
| | L2 | X | | | | | | | X | X | X | X | X | X | | | | | | | | | | | | | | | | |
| | L3 | | X | | | | | | X | | | | | | X | X | X | X | X | | | | | | | | | | | |
| | L4 | | | X | | | | | | X | | | | | X | | | | | X | X | X | X | | | | | | | |
| | L5 | | | | X | | | | | | X | | | | | X | | | | X | | | | X | X | X | | | | |
| | L6 | | | | | X | | | | | | X | | | | | X | | | | X | | | X | | | X | X | | |
| | L7 | | | | | | X | | | | | | X | | | | | X | | | | X | | | X | | X | | X |
| | L8 | | | | | | | X | | | | | | X | | | | | X | | | | X | | | X | | X | X |

FIG 7

KEYING MECHANISM FOR A MODULAR I/O ASSEMBLY

This application is based on a Provisional Patent Application entitled "Keying Mechanism for a Modular I/O Assembly" filed Oct. 4, 1996 by Donald L. Oros at. al and having application No. 60/027,881.

BACKGROUND OF THE INVENTION

1. Field of the Invention

The present invention relates generally to modular I/O electrical assemblies and more particularly to methods and devices for preventing the mismatched mating of elements of electrical assemblies used to configure the I/O assembly.

2. Description of the Prior Art

It is known to assemble I/O devices into cabinetry and to connect same to its power and signal sources by connections made inside a cabinet with the cabinet then being connected into a unified process control system. As an example, U.S. Pat. No. 3,942,077 to Powers, U.S. Pat. No. 4,152,750 to Bremenour et. al., U.S. Pat. No. 4,334,261 to Gonzales and U.S. Pat. No. 5,423,697 to MacGregor all teach various aspects of such systems.

Furthermore, some known prior art I/O assemblies even have markings on each element of these assemblies to help the assembler in making a proper assembly of an I/O unit to its properly matched signal and power source. Nevertheless, there were still improperly made connections which caused these units to be damaged when they were powered up in a mismatched manner. Thus a device and method was required which would physically prevent the joining of mismatched I/O units to improper signal and power sources.

SUMMARY OF THE INVENTION

The present invention solves the problems associated with prior art devices and others by providing a device and method which would physically prevent the joining of mismatched I/O units to improper signal and power sources. To accomplish same, a plurality of holes are provided in the connector base and the I/O module of the I/O assembly which is mounted to proper power and signal sources in a control cabinet. The connector base holes are fitted with predetermined pegs in specific holes to thus identify a particular module for mating with that unique pattern of pegs. A selectively patterned polycarbonate sheet with adhesive is made to cover all but the holes matching the mating connector block to insure that any attempt to mate that block with an inappropriate connector base will be blocked. This blocking will be provided by the pegs of the module being unable to connect to the connector base because of the matching holes being covered by the strong polycarbonate sheet which is not easily pierced by the pegs. Thus improper electrical connection will be prevented with I/O modules being connectable only with connector bases having the matching hole orientation fitting the identifying peg orientation.

In view of the foregoing it will be seen that one aspect of the present invention is to provide a physical system for preventing the assembly of an electrical component to an improper power and signal connection.

Another aspect of the present invention is to provide a physical system for preventing the assembly of an I/O unit to an improper power and signal connection in an I/O cabinet.

Yet another aspect of the present invention is to provide a system for identifying each of a plurality of differing electrical components by a predetermined number of selectively configured protrusions on the back of each component which conform to only a matching power and signal connector having a compatible hole configuration matching the protrusions on the component.

These and other aspects of the present invention will be more fully understood after a review of the following description of the preferred embodiment when considered along with the accompanying drawings.

BRIEF DESCRIPTION OF THE DRAWINGS

FIG. 7. Is a chart of the various hole patterns used to identify a particular I/O module.

DESCRIPTION OF THE PREFERRED EMBODIMENT

Figure 1:
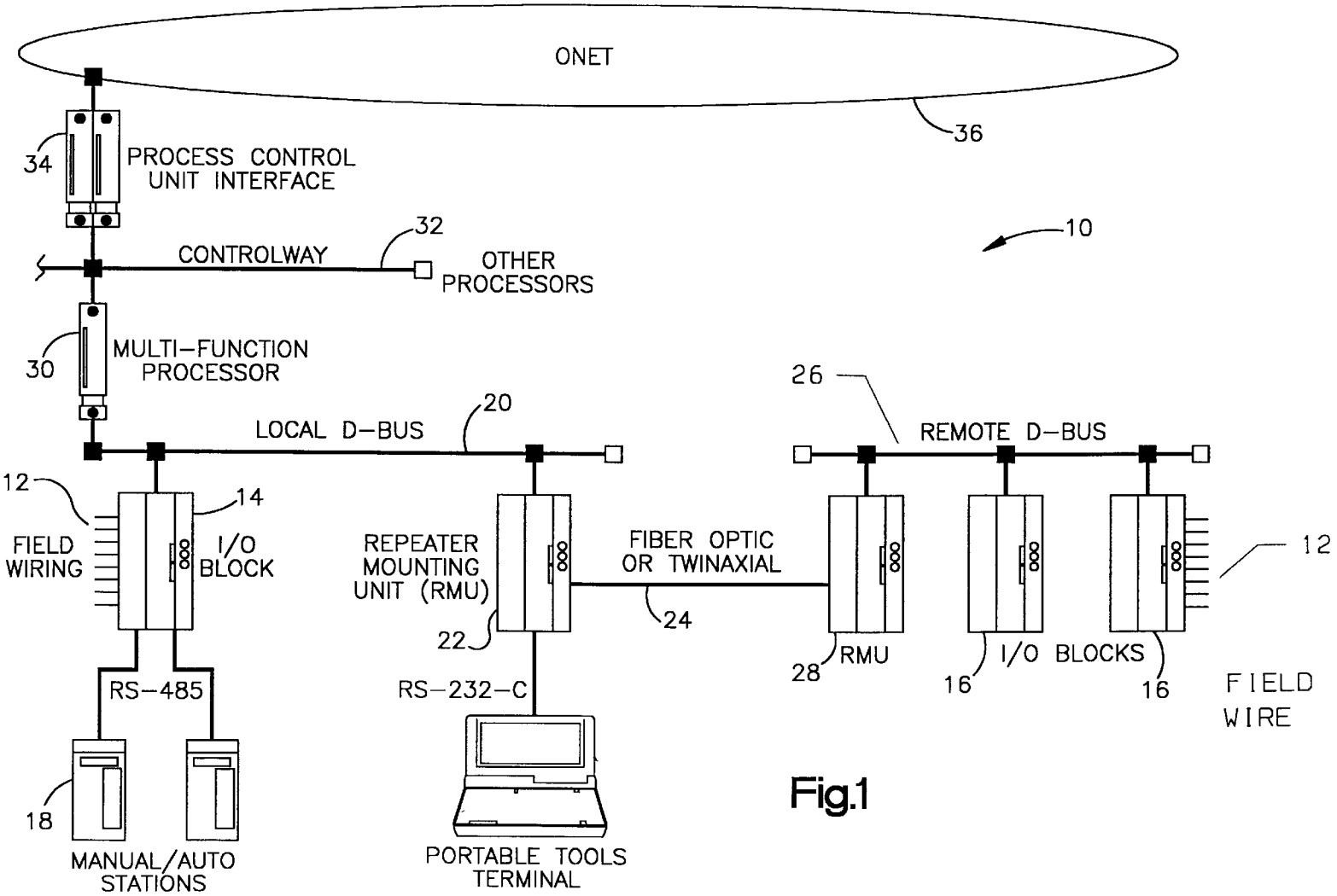
FIG. 1. Is a schematic of a distributed process control system using the block I/O system of the present invention.

Referring now to the drawings wherein the showings are for purposes of detailing a preferred embodiment of the invention and are not intended to limit it to same, FIG. 1 shows a known distributed process control system 10 such as the ELSAG BAILEY Symphony™ system. Process signals are inputted along field wiring lines 12 to a series of local and remote I/O blocks 14, 16. While I/O block 14 is shown connected to manual/auto stations 18 for allowing operator control of the signals it will be understood that any of these I/O blocks could be similarly connected. Since the local D-bus 20 is relatively short (around 50 meters) a repeater mounting unit 22 (RMU) is connected to the local I/O block for conditioning the signal so it may be transmitted by either fiber optic or twin axial cable 24 to a remotely located D-bus 26. This is done by way of a second RMU 28 for reconditioning the signal transmitted by the first RMU so it is readable by the I/O blocks 16 connected to the remote D-bus.

The various process control signals collected along the local and remote D-bus 20, 26 are connected to a multi function control processor 30. Other processors may be also connected to these D-buses and their control signals along with that of the processor 30 would thus be connected to a controlway 32 which sends the signals to a process control unit interface 34 for conditioning these signals for use by a control room process unit such as the Elsag Bailey OMNI-NET™ process control system 36.

Figure 2:
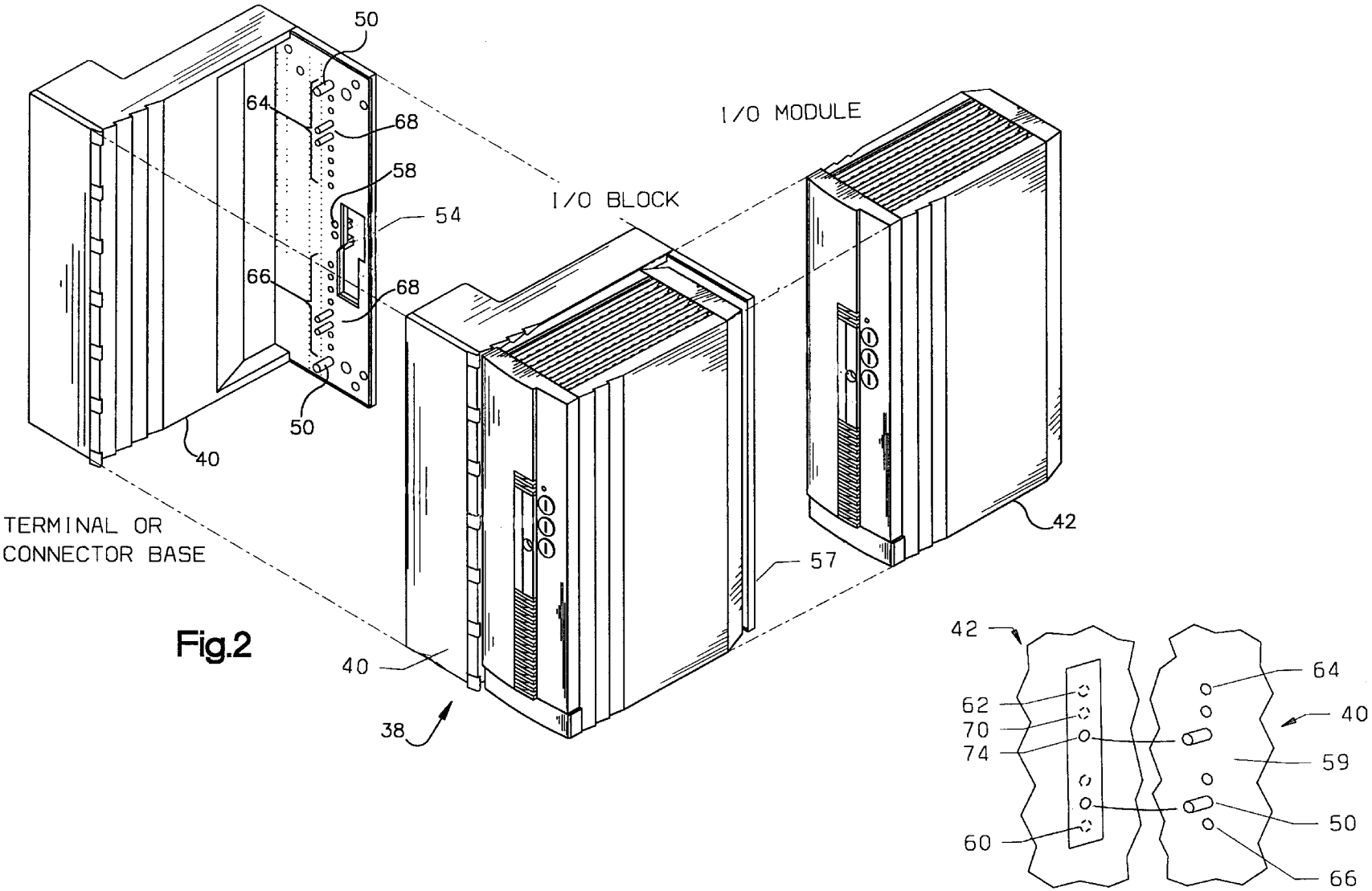
FIG. 2. Depicts a block I/O assembly showing the connector base and I/O module comprising same including a schematic blow up illustrating the keying mechanism.

As is shown in FIG. 2, the basic I/O block 38 is made up of a terminal or connector base 40 and an I/O module 42.

Figure 3:
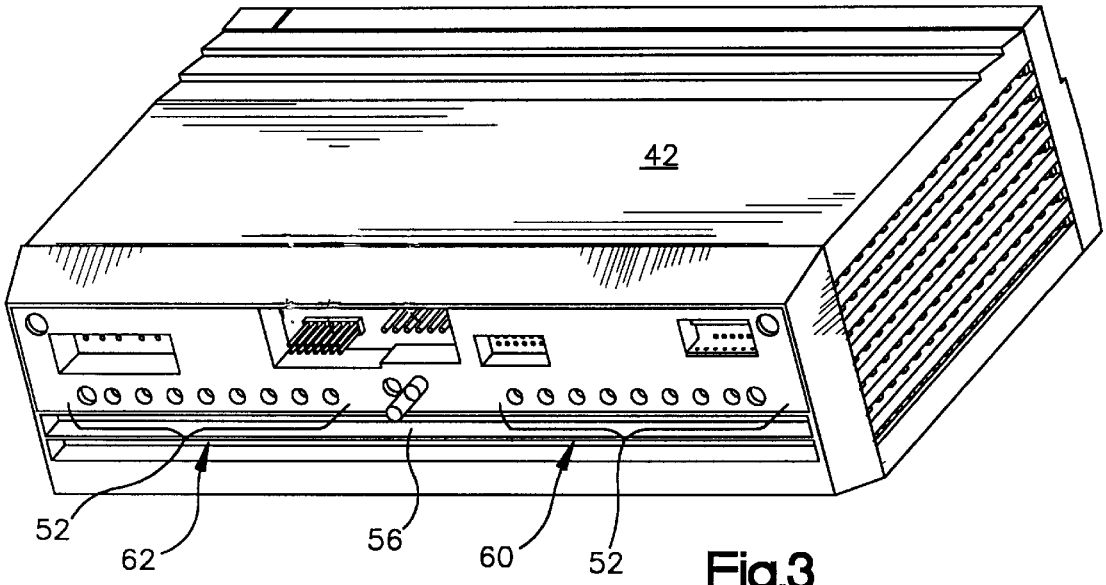
FIG. 3. Is a rear view of the I/O module showing the general pattern of holes found therein for orienting plugs therein according to an identifying pattern.
Figure 4:
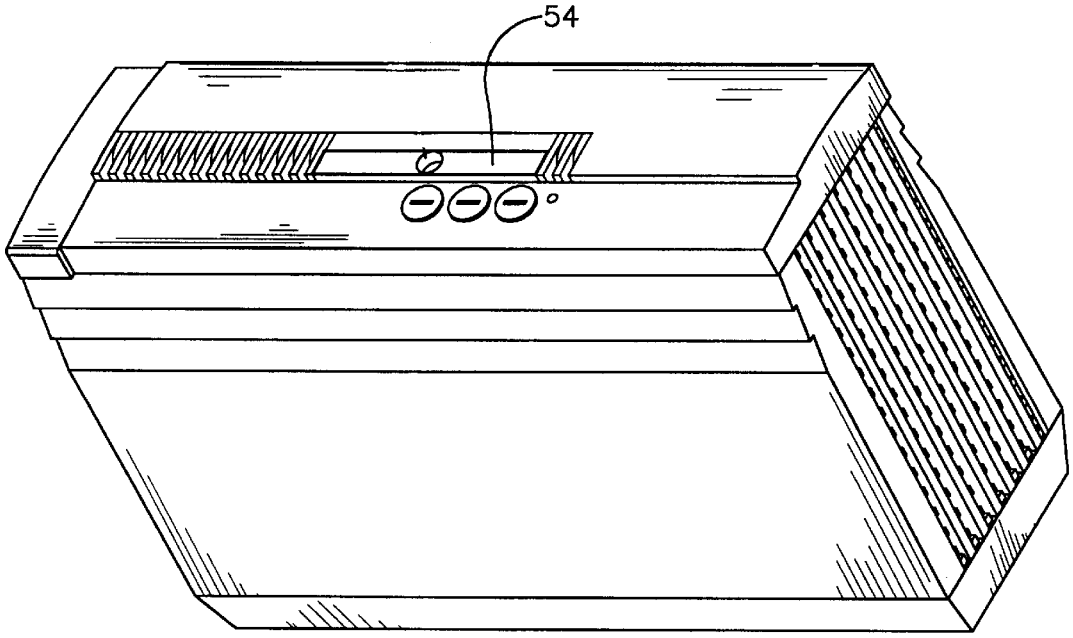
FIG. 4. Is a front view of the I/O module.
Figure 8:
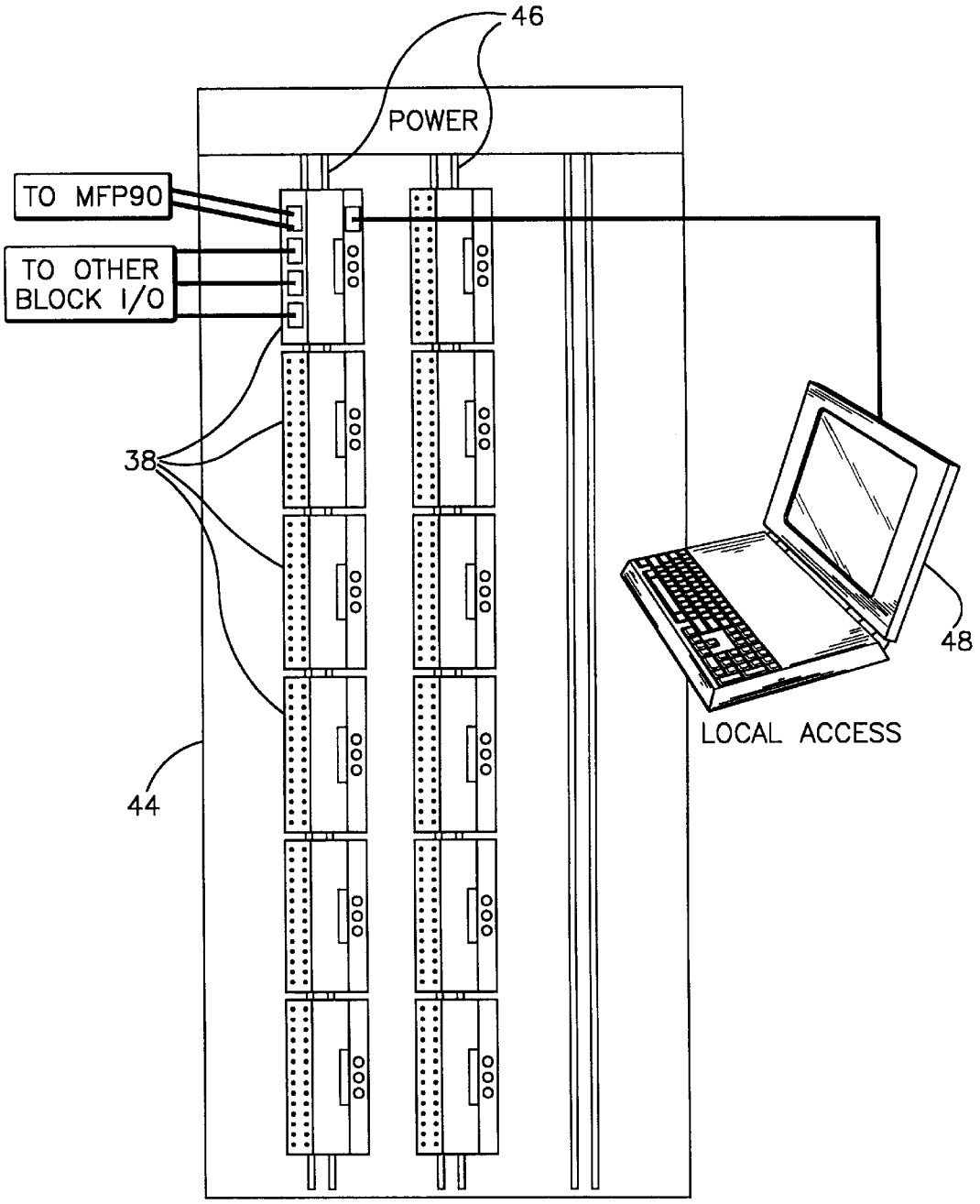
FIG. 8. Is a front view of a control cabinet having a plurality of I/O module assemblies connected therein.

Each I/O block is specifically programmed or configured for specific functions and is mounted into a cabinet 44 best seen in FIG. 8. The individual block I/O's are connected to communicate with each other as well as providing local access through laptop computers 46. The connector base 40 is mounted in a known manner such as by screws or clips to a conductive column 48 found in the cabinet 44 which provides power to the I/O blocks 38 as well as communication therebetween. The I/O module is then connected to the I/O base 40 by pushing it onto guide pins 50 located on a back plane 59 formed as an extension wing of the base 40 which fit into appropriately aligned apertures 52 on the back of the I/O module 42 as seen in FIG. 3. The module 42 is then locked to the base 40 by pushing handle 54 to extend and lock the mechanism 56 into the base aperture 58.

Each individual I/O block 38 is programmed for a specific function and it is imperative to make sure that the proper module 42 is inserted into the proper base. To insure this ability, the base and module are specifically configured to physically prevent the mating of an I/O module with other than its properly connected base having the requisite power and signal sources usable by that I/O module.

Figure 5:
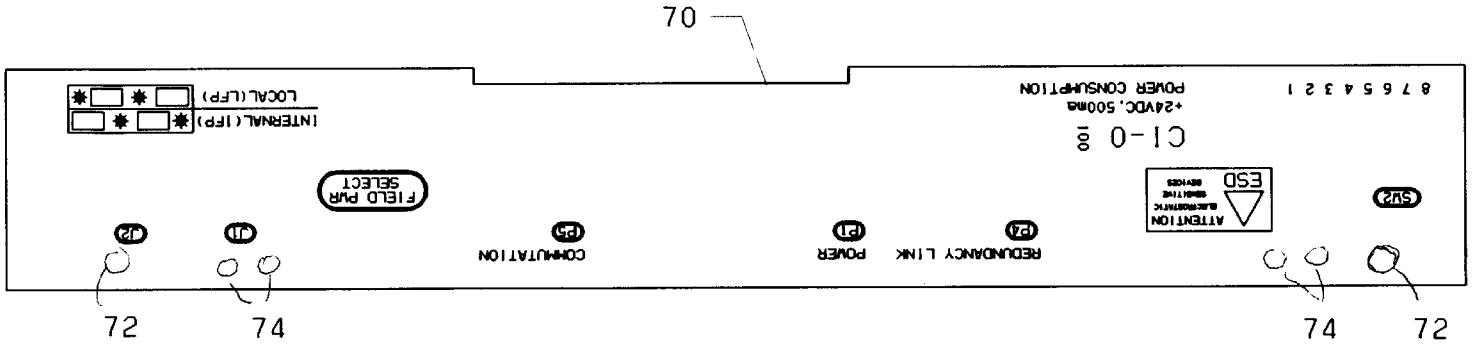
FIG. 5. Is a top view of the adhesive backed polycarbonate sheet that has a particular pattern of covered and uncovered holes identifying a particular module, namely the CIO-100, which is affixed over the back of the I/O module and identifying the CIO-100 module by the pattern of holes defined in the FIG. 7 table under this module.
Figure 6:
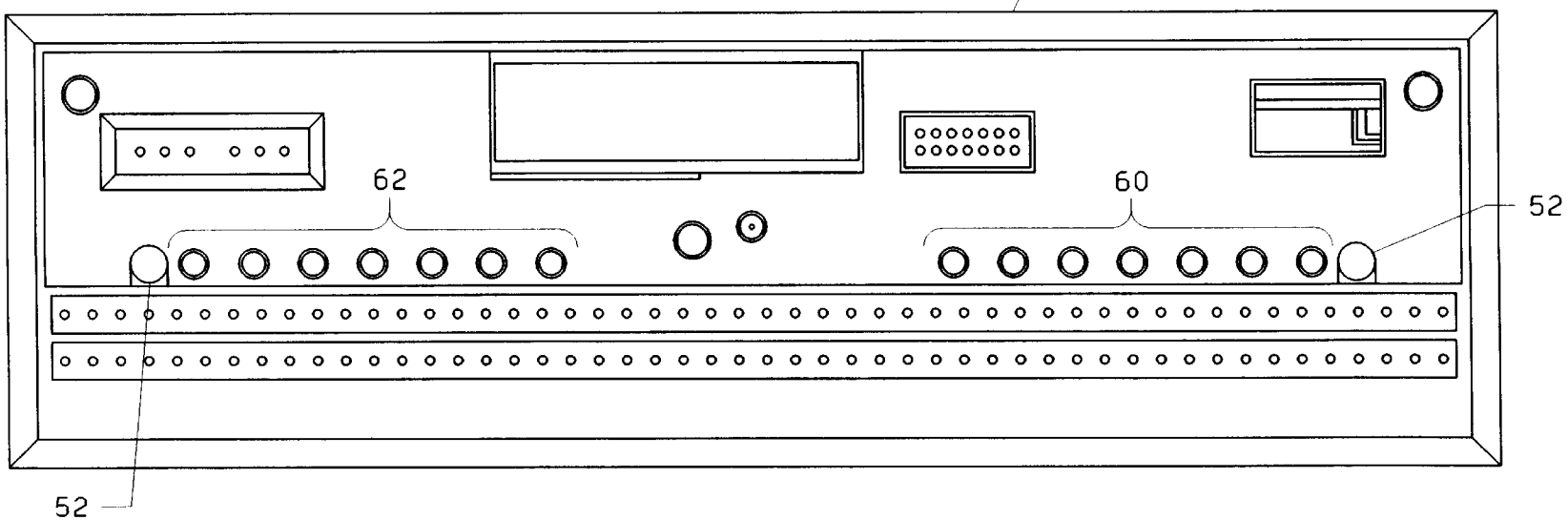
FIG. 6. Is an expanded view of the back of the I/O module showing the area of apertures that will be selectively covered with the polycarbonate sheet of FIG. 5.

As seen in FIGS. 5–7, this is accomplished by providing eight upper and lower holes 60, 62 on the back of the module 42 which are alignable through the pegs 50 on the base 40 with complimentary eight upper and lower holes 64, 66 on the base 40. The holes 64, 66 on the base 40 are then selectively fitted with pegs 68 according to the X pattern defining the different types of I/O modules seen in FIG. 7. A polycarbonate material sheet 70, which may have an adhesive back, is then affixed to the back of the module in a known manner, such as gluing. The sheet 70 has holes 72 for allowing the alignment pins 50 to pass into the alignment holes 52. The sheet 70 also selectively blocks certain of the upper and lower holes 60. It also selectively provides openings 74 only for the configuring pins. Thus the sheet 70 is also configured according to the X pattern found in FIG. 8 but with openings found only in the area of the pegs 68. This allows only the complimentarily configured module to fit into its base 50. Any other configuration of pegs 68 would interfere with the sheet 70 sealed holes and would not mate properly. It will be understood that the sheet is strong enough to prevent the forcible entry of the pegs through the sheet.

Turning to FIG. 7, it will be seen that there are presently 12 different hole configurations marked RA1–RA12 to define 12 different I/O modules presently being used. There are 16 other unique configurations remaining, which are marked FUTURE for new modules to be developed. As seen in the second row, the existing I/O blocks are identified by the following code:

I=Input

O=Output

D=Digital

A=Analog

C=Combination

The numbers 100, 200, 300, 400, 120, 150 and 220 refer to different voltage and configuration levels of the I/O block. From the foregoing it becomes obvious why proper voltage (power) and signal inputs need to be applied to the proper I/O module since any mismatch would cause at least inoperative results due to insufficient power if not catastrophic results from over voltage applications.

The remaining row defines the upper and lower holes 60 and 62 on the I/O module as well as the upper and lower holes 64, 66 on the connector base as KU1–KU8 and KL1–KL8 respectively. The X designation within the boxes indicates where the pegs 68 are fitted into the holes 64, 66 and which label of the twelve labels A1–A12 is to be glued or otherwise applied to the back of the I/O module to allow only the appropriate hole openings to be left open of the holes 60, 62. This insures that only the correct I/O module is mated to the correct connector block. The connector block is hard wired in the case 44 to have the proper power and signal connections for the mating I/O module.

It should be noted that the number of hole and peg combinations to be actually used, twenty-eight, is much less than the total number of combinations possible with 16 pin positions. The peg and hole combinations were limited to those identified in FIG. 7 to insure that at least two pegs were used in the upper location and that at least two pegs were also used in the lower location of the connector base. The use of single peg keying would not prevent the at least partial insertion of an I/O module with two holes into a connector base with only a single peg.

Additionally, pegs have purposely been located in each of the upper and lower hole areas. This type of location prevents inadvertent connection or partial connection due to cocking of the I/O module into an improper connector base.

From the foregoing it will be seen that a system for physically preventing an improper mating of an I/O module to an improper connector base is provided. Since the base is hard wired in the cabinet and checked for proper signal and power, the I/O module is then assured of proper connection in the field during any initial installation or any subsequent repair replacement or reconfiguration.

Certain additional material detailing obvious modifications, additions as well as differing applications of this concept have been deleted herein for the sake of conciseness and readability but are properly intended to be within the scope of the following claims.

We claim:

1. A method of connecting a plurality of different electrical modules each requiring different signal and power connections to a plurality of connection bases connected to the different signal and power connections required by the different modules comprising the steps of:

providing a series of alignable apertures on each of said plurality of modules and bases;

mapping various unique aperture configurations identifying each of the differing signal and power connections required by the plurality of modules and connected to the plurality of bases to insure a one to one relation therebetween:

placing pegs in the apertures of each of the bases to identify each unique configuration and the signal and power connection denoted thereby; and placing a mask on each of the modules according to the unique configuration of the pegs in the bases, the mask having openings located to leave uncovered only the apertures where the pegs would enter the module of a compatible base and module to physically prevent the mating of incompatible bases and modules thereby.

2. A method as set forth in claim 1 wherein the modules are I/O modules of an I/O assembly having connector bases connected to different power and signal inputs in an I/O cabinet.

3. A method as set forth in claim 2 wherein the mapping of aperture configurations includes the identifying of the type of signal and the voltage level of the power input.

4. A system for insuring the proper connection of each of a plurality of electrical components to signal and power inputs specifically designed for each of said component comprising:

each component having a connecting member having an identical first series of apertures adaptable to have pins placed in said apertures to form a specifically desired component connectable to a first desired signal and power level suitable for said desired component;

one of a plurality of electrical component having a second series of apertures alignable with said first apertures in said connecting member and having a mask affixed over said second apertures;

said electrical components having a mask, which provides openings to only second apertures alignable with said pegs in said first apertures to insure the proper mating of connecting member to its electrical component.

5. A system as set forth in claim 4 wherein said electrical component is an I/O module and said connecting member is a connecting base of an I/O assembly being electrically connected to a specific series of signals and a specific power level.

6. A system as set forth in claim 5 including a series of I/O modules having differing signal and power input requirements and a series of connecting bases for said modules each connected to differing signal and power levels and wherein each connecting base has a different configuration of pins identifying the particular signal and power level applied to each connector base.

7. A system as set forth in claim 6 wherein each of said modules has a unique mask covering said first apertures according to a pattern identifying each module and wherein each unique peg configuration has a unique mask to insure the mating of compatible modules with connector bases.

8. A system as set forth in claim 7 wherein said mask is made from polycarbonate sheet material which is affixed to the back of each module to cover a specific pattern of apertures.

9. A system for insuring the proper connection of a plurality of different I/O modules only to required signal and power inputs comprising:

a plurality of connector bases mounted to a conductive column providing power to said modules and communication therebetween and having a particular unique connection of signal and power connections identified by a particular unique orientation of pegs on the face of each of said bases, a plurality of I/O modules connectable to each of said bases by a series of openings along the back thereof mating with the peg configuration on each of said bases; and a mask covering some of said openings on each of said modules to leave uncovered only the holes for the particular unique peg orientation on each of said bases to prevent the mating of the module with other than its corresponding connector base.

10. A system as set forth in claim 9 wherein said mask is a polycarbonate plastic material mask affixed to the back of said module.

11. A system as set forth in claim 10 including a series of I/O modules having differing signal and power input requirements and a series of connecting bases for said modules each connected to differing signal and power levels and wherein each connecting base has a different configuration of pins identifying the particular signal and power level applied to each connector base.

12. A system as set forth in claim 11 wherein each of said modules has a unique mask covering said apertures according to a pattern identifying each module and wherein each unique pin configuration has a unique mask to insure the mating of compatible modules with connector bases.

13. A system as set forth in claim 9 including a peg located in each upper and lower hole area to prevent partial connection due to cocking of said I/O module to said base.

* * * * *